US009395077B2

(12) United States Patent
Flynn

(10) Patent No.: US 9,395,077 B2
(45) Date of Patent: Jul. 19, 2016

(54) FLASHLIGHT WITH INTEGRATED SPRAY REPELLENT

(71) Applicant: Michael Flynn, Newport Beach, CA (US)

(72) Inventor: Michael Flynn, Newport Beach, CA (US)

(73) Assignee: Myrna Flynn, Huntington Beach, CA (US)

( * ) Notice: Subject to any disclaimer, the term of this patent is extended or adjusted under 35 U.S.C. 154(b) by 118 days.

(21) Appl. No.: 14/477,871

(22) Filed: Sep. 5, 2014

(65) Prior Publication Data

US 2016/0069560 A1 Mar. 10, 2016

(51) Int. Cl.

| | |
|---|---|
| ***F21L 4/00*** | (2006.01) |
| ***F21V 33/00*** | (2006.01) |
| ***F41H 9/10*** | (2006.01) |

(52) U.S. Cl.

CPC ..... *F21V 33/0076* (2013.01); *F21L 4/005* (2013.01); *F41H 9/10* (2013.01)

(58) Field of Classification Search

CPC ..... F41H 9/10; F21L 4/022; F21L 4/005; F21V 33/0076; A61M 11/00; B05B 15/00

See application file for complete search history.

(56) References Cited

U.S. PATENT DOCUMENTS 5,941,629 A * 8/1999 Tuscher ..... F41H 9/10 222/113

* cited by examiner

*Primary Examiner* — Karabi Guharay

(74) *Attorney, Agent, or Firm* — Ali Shalchi, Esq.

(57) ABSTRACT

A flashlight with integrated spray repellent is provided that provides a more effective and efficient means of self-defense and safety. The flashlight comprises a main body, a flashlight head on a distal end and a spray enclosure on a distal end. A spray repellent device is housed within the proximal end of the main body and the spray enclosure, the spray repellent device further comprising a spray head and a spray canister containing a repellent substance. The spray enclosure has two opposing openings: a spray trigger opening for accessing the spray trigger and a spray nozzle opening for expelling the repellent substance. In an alternate embodiment, the flashlight features a curved flashlight head such that the light and the spray face the same direction and can be used simultaneously.

2 Claims, 7 Drawing Sheets

FLASHLIGHT WITH INTEGRATED SPRAY REPELLENT

RELATED U.S. APPLICATION DATA

This application claims priority to Provisional Application No. 61/873,363, filed Sep. 4, 2013.

FIELD OF THE INVENTION

The present invention relates to flashlights and self-defense devices.

BACKGROUND OF THE INVENTION

The unpredictable nature of tactical combat and self-defense calls attention to the need for weapons and devices which maximize user capabilities and provide versatile performance for a variety of adverse situations. Any method of improving capability and reaction times or eliminating unnecessary actions or devices would improve safety and efficiency in self-defense, combat or personnel containment situations. Typically, users must carry a variety of devices and switch between them as needed, which exposes the user to risk of harm in time-critical scenarios. There is a need in the art for devices that serve a dual purpose and thus save space and time in the context of self-defense and combat situations. It would be particularly advantageous to add new capabilities to trusted weaponry and equipment.

SUMMARY OF THE INVENTION

A repellent spray-integrated, full-powered flashlight offers a method of consolidated self-defense readiness whereby a plurality of law enforcement/tactical non-lethal weaponry and/or gear may be combined into one hybrid piece of gear, hence providing for the dual-wielding of the once separate weapons/tools. The device comprises a full-powered flashlight and a conventional repellent spray device that is housed within the handle, of the flashlight. The present invention allows for simultaneous use of the flashlight and spray repellent functionalities which eliminates the need to utilize separate devices, a critical advantage in self-defense or combat scenarios where reaction time is of the essence.

DETAILED DESCRIPTION

Figure 1:
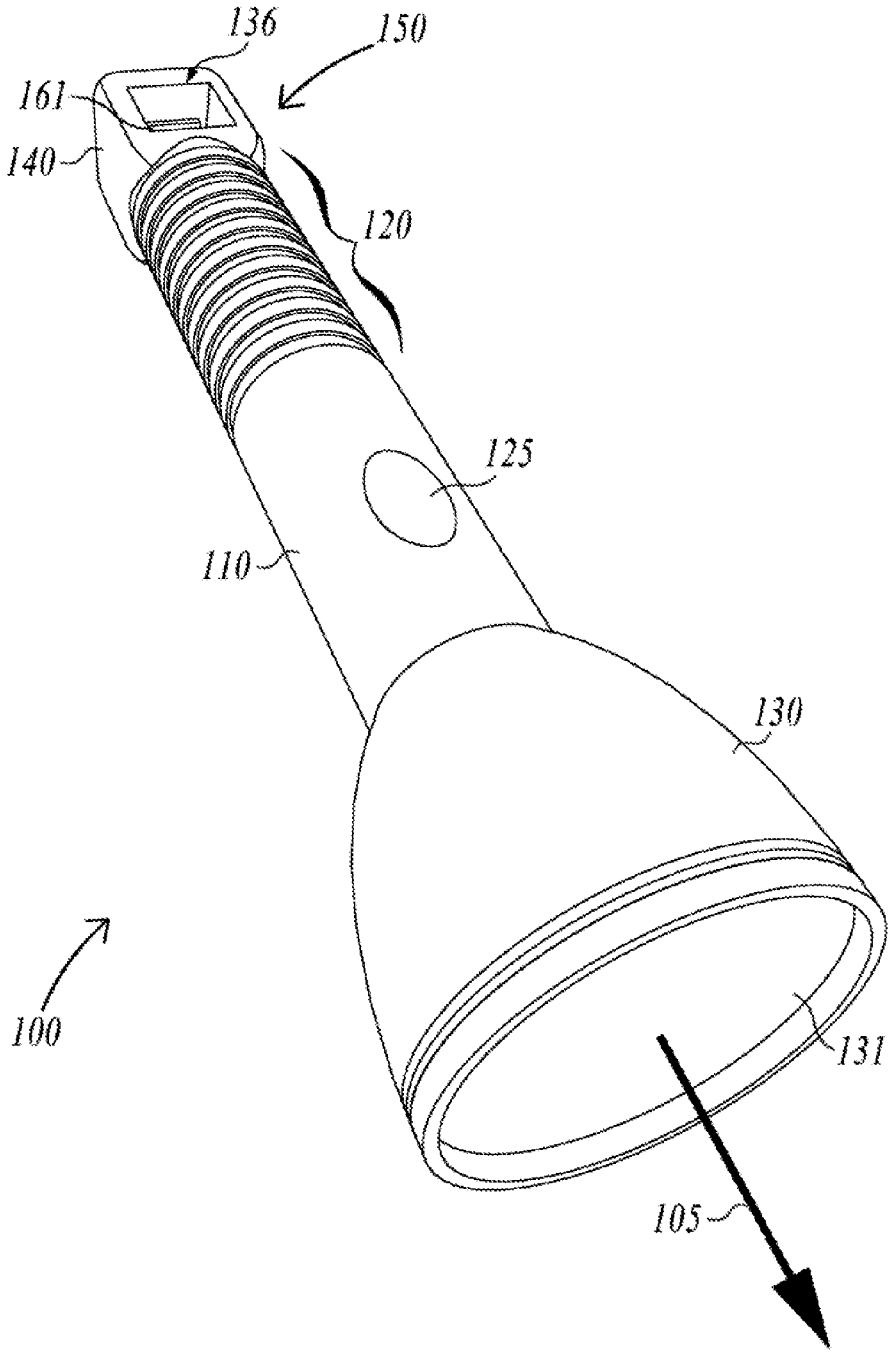
FIG. 1 illustrates a perspective view of the spray-integrated flashlight with the light-emitting area facing the viewer.

FIG. 1 illustrates a perspective view of the spray-integrated flashlight with light-emitting area facing the viewer. The dual-function spray-integrated flashlight device 100 comprises a hollow handle body 110 which terminates at a proximal end (the end farthest from the viewer) with a spray spray enclosure 140 (i.e. "spray enclosure"), and terminates on the opposing distal end with a flashlight head 130. The direction of light emission is denoted by motion arrow 105. The handle body 110 further comprises a light control button 125 and is covered by a ribbed grip portion 120 found below the light control button 125 and nearer to the spray enclosure 140. This grip portion, serves as an ergonomic handle for operating either the flashlight or spray portion of the unit. The repellent spray device 150 (i.e. "spray device") is housed within the proximal end of the handle body 110 and spray enclosure 140. The spray device 150 comprises a spray trigger 160, a spray nozzle (see FIG. 3) and a spray canister (see FIG. 2) containing the repellent substance. The spray enclosure 140 is hollow and contains two openings: a spray nozzle opening (see FIG. 3) and spray trigger opening 136 (shown in FIG. 2), which are positioned on opposing sides of the spray enclosure 140. The spray enclosure 140 acts to both protect, and allow access to, the upper portion of the spray device (i.e. the spray nozzle and the spray trigger) to prevent damage or accidental use of the spray device. In this figure, the repellent spray trigger 161 can be partially seen through the spray trigger opening. 136 of spray enclosure 140. During usage, the user would place their thumb or other digit into the spray enclosure 140 via the spray trigger opening 136 and engage the spray trigger 161 to expel the repellent spray via the spray nozzle. Common to standard repellent spray device usage, this action would be accomplished by pressing downward on the spray trigger 161 in the direction indicated by motion arrow 105.

As briefly mentioned above, the flashlight head 130 is a standard, full-powered unit which can comprise a standard system of battery-powered fluorescent/led light(s), in conjunction with an interior reflector and lens 131 composed of plastic or glass. Activation/deactivation of the flashlight portion is achieved by pressing the light control button 125, in a direction perpendicular to motion arrow 105. This button could alternatively be a sliding switch or other mechanism as known in the art. In a common usage scenario, utilization of the flashlight portion of the unit may quickly be followed by spray utilization by simply rotating the flashlight 100 so that the light-emitting area of the flashlight is facing the ground while maintaining a grip on the ribbed grip portion 120. In any such usage scenario (where utilization of the spray occurs in tandem with usage of the light) the spray nozzle is never required to be facing the user, as both the flashlight on/off button (light control button 125) and spray trigger 161 are both found on the same side of the handle body 110. As described below, the spray device 150 can be replaced when necessary by removal or repositioning of the spray enclosure 140.

Figure 2:
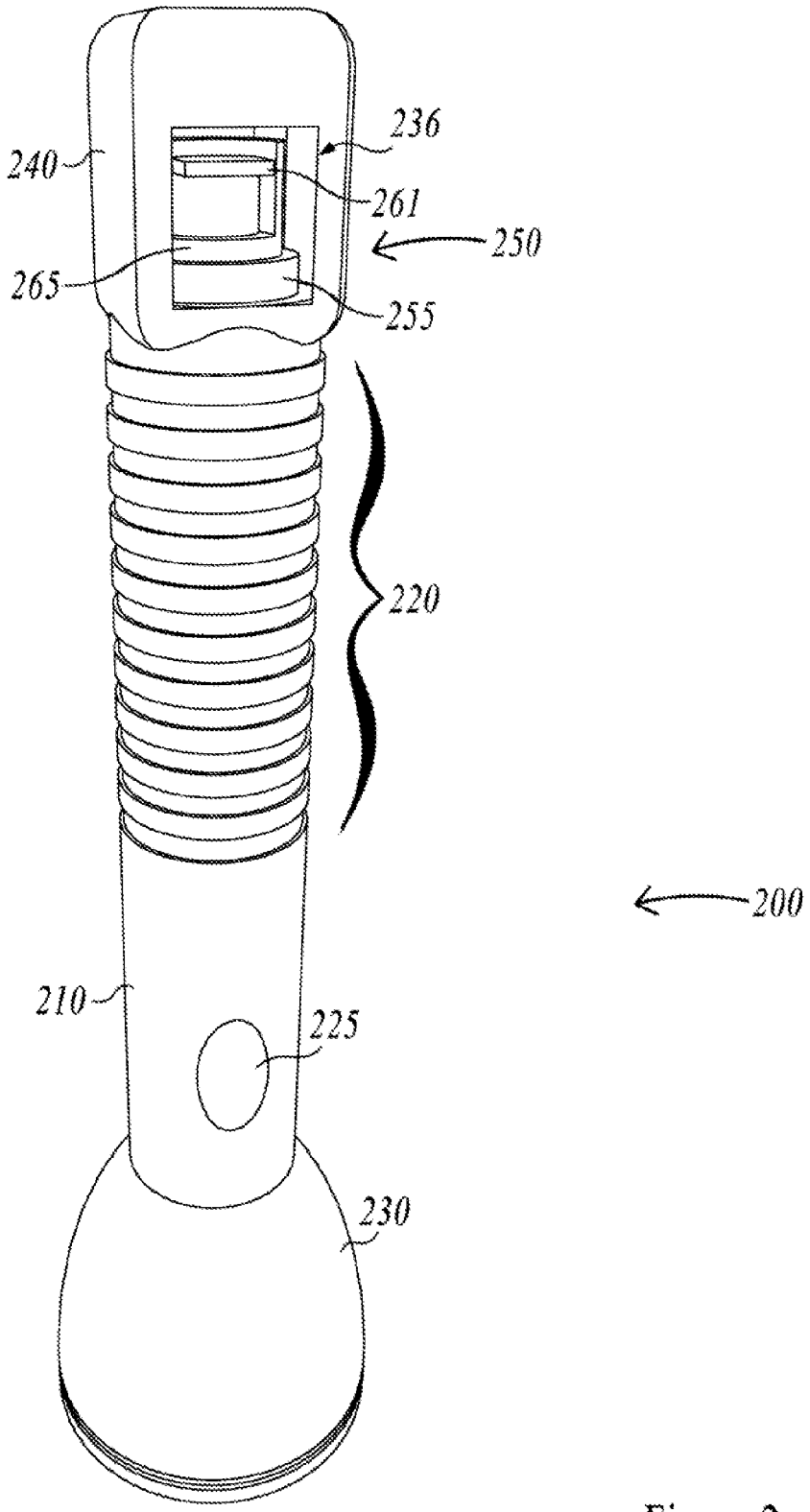
FIG. 2 illustrates a perspective view of the spray-integrated flashlight with repellent spray trigger facing the viewer.

FIG. 2 illustrates a perspective view of the spray-integrated flashlight 200 with the repellent spray trigger 261 facing the viewer. As described above, the spray-integrated flashlight 200 comprises a handle body 210, a flashlight head 230, and an spray enclosure 240. The handle body 210, with ribbed grip portion 220 and light-activation button 225, is a hollow tube that houses the repellent spray device 250. Spray trigger opening 236 provides the user with access to the spray trigger 261. The repellent spray device 250 can be a standard off-the-shelf device that fits the dimensions of the handle body 210 and spray enclosure 240. The spray device 250 comprises a spray head 265 with a spray trigger 261, and a spray canister 255 that contains the pressurized chemical substance. This repellent spray device 250 can be replaced/installed by twisting the spray enclosure 240 and removing it from the handle body 210, thereby exposing the hollow interior of handle body 210 which is configured to receive the spray device 250. This action would occur via a threaded portion on the bottom of the spray enclosure 240 which, in this figure, lies on the interior of the handle body 210. Similarly, at the distal end of the device, the flashlight head 230 may be twisted off/on to replace batteries housed within the handle body 210 as is commonly done. During usage, the user would grab the ribbed grip handle 220 (at the side facing the viewer) and place their thumb or other digit on the spray trigger 261, expelling its contents at an intended target. Again, the thumb/digit would execute this motion by entering the spray trigger opening 236 of the spray enclosure 240 (which faces the viewer in this figure), and pressing downward on the spray trigger.

Figure 3:
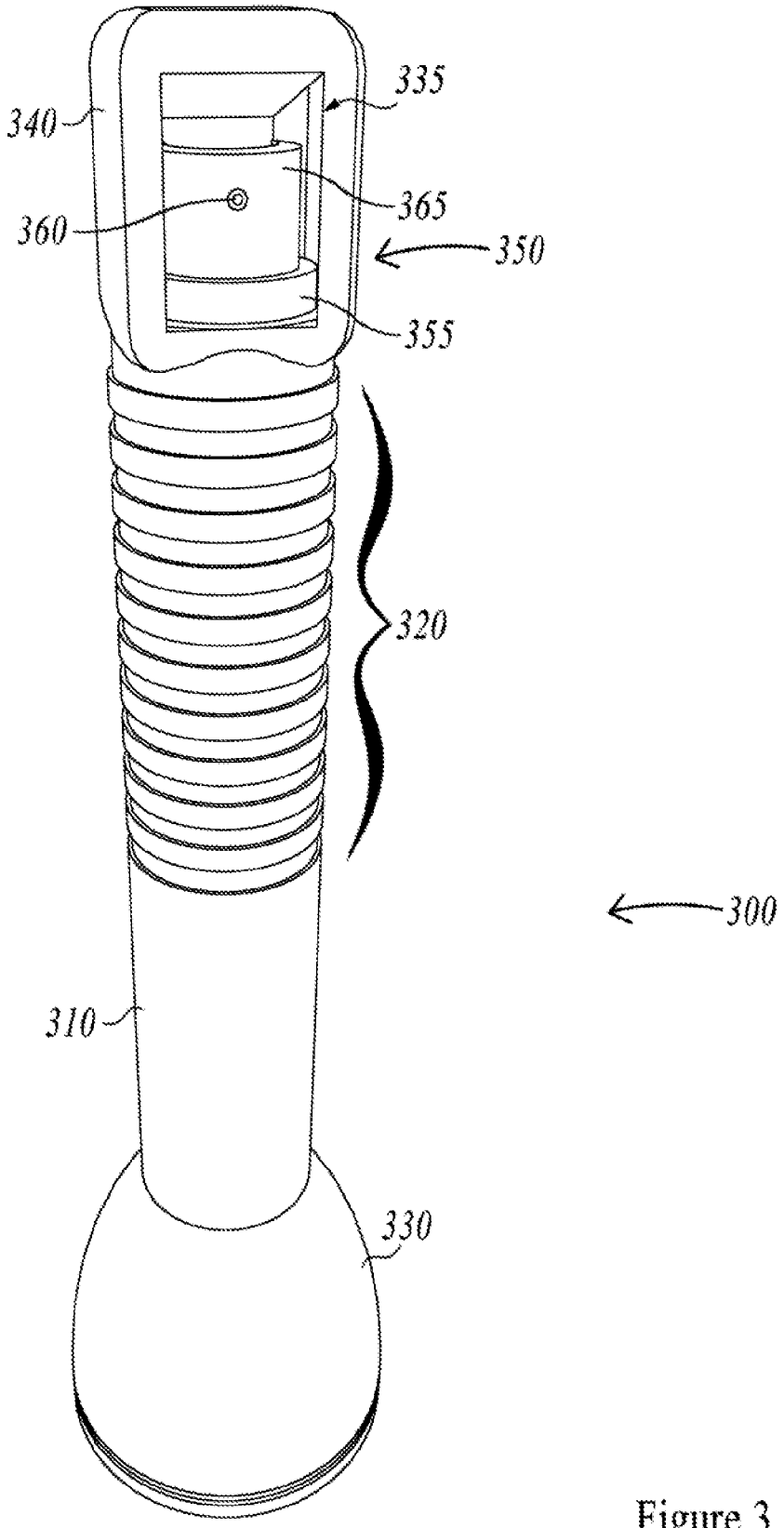
FIG. 3 illustrates a perspective view of the spray-integrated flashlight with repellent spray nozzle facing the viewer.

FIG. 3 illustrates a perspective view of the spray-integrated flashlight with repellent spray nozzle facing the viewer. The spray-integrated flashlight 300 has a handle body 310, which terminates in the flashlight head 330 at its bottom, and the spray enclosure 340 at its top. In contrast to FIG. 2, this figure shows the opposite side of the unit, showing that the spray enclosure 340 further comprises a spray nozzle opening 335, through which the spray nozzle 360 is visible on the spray head 365, along with the top of the chemical compound canister 355 (i.e. repellent/spray canister). Ideally, this side of the unit should never face the user in a combat/self-defense situation. The exception is situations where the desired target is over the shoulder of the user, such as in a rear-attack situation where the user is being held from behind. However, in the vast majority of scenarios, the spray nozzle 360 will be facing the ground or the direction of the user's line of sight prior to utilization. In this figure, the spray nozzle opening 335 of the spray enclosure 340 faces the viewer. The spray head 365 of the spray device 350, and the top portion of the spray canister 355 is housed within the spray enclosure 340, with the remainder of the spray canister housed in handle body 310 that is covered by ribbed grip portion 320.

Upon inserting a repellent spray device 350 (standard, off-the-shelf variety), an expandable/contracting grasping mechanism within the handle body 310 may engage it to allow for the stabilization of the spray device, fixing it in place for regular usage until removal. This mechanism may be augmented by a release switch found somewhere conveniently accessible by the user. As well, the nature of the specific repellent spray device 350 that is used, and/or the size and dimensions of the spray enclosure 340 may dictate the spray device's facility to be incorporated into the spray-integrated flashlight device 300. For instance, a repellent spray device 350 with a spray head 365 large enough in height may be stabilized by the twisting of the spray enclosure 340 onto the handle body 310, whereby the top surface of the spray head 365 makes contact with the top interior surface of the spray enclosure 340. In such a scenario, the spray enclosure would, by its mere presence, exert a stabilizing force upon the top surface of the repellent spray device 350. Additionally, the most compatible manufacturing solution may be a minor augmentation of the spray enclosure 340, whereby its bottom surface possesses an opening that is at least as large in circumference as the spray head 365 of the repellent spray device 350. As in the aforementioned solution, the mere twisting of the spray enclosure 340 onto the handle body 310 would exert a stabilizing force upon the repellent spray device 355—this time upon the top surface of the spray canister 355. Hence, the bottom exterior surface (threaded portion notwithstanding) of the spray enclosure 340 would make contact with the top surface of the spray device's spray canister 355, fixing it into a static position for regular usage of the device 300. Under these circumstances, a regular installation of said repellent spray device 350 would result in a spray canister 355 that is obscured from view, i.e. beneath the spray enclosure 340 and completely enclosed by the handle body 310.

Figure 4:
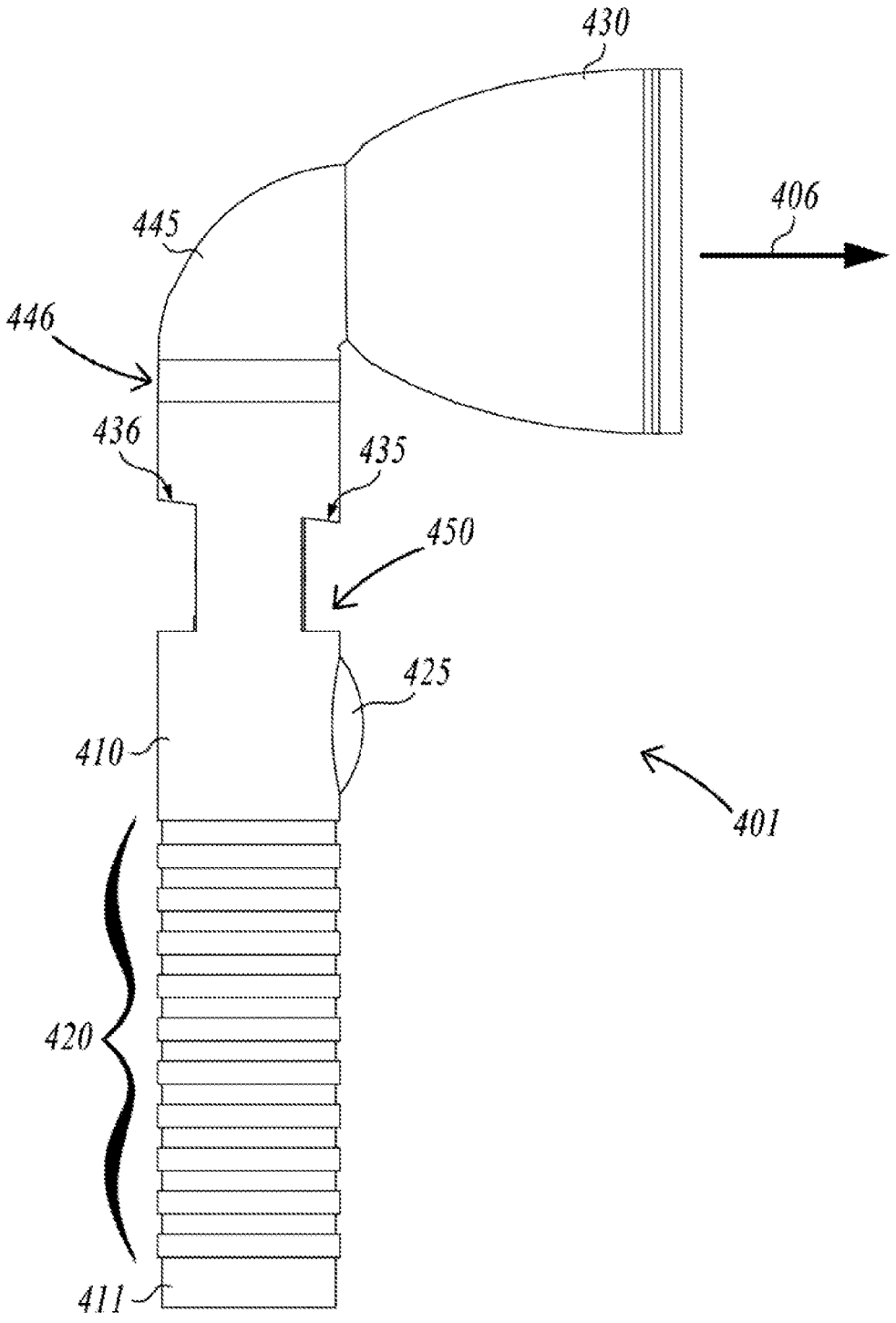
FIG. 4 illustrates a side view of an alternate embodiment of the spray-integrated flashlight having a curved segment by which the light-emitting area and the handle body are connected.

FIGS. 4-7 depict an alternate embodiment of the spray-integrated flashlight. This embodiment features a curved segment in which the light-emitting area and the handle body are connected at a right angle (perpendicular) to each other. The curved segment aligns the direction of the light projection with that of the spray repellent, such that the light can be focused on a target while deploying the spray repellent. There, the flashlight need not be manipulated in order to switch from use of the light to use of the spray repellent. Thus, this embodiment provides a more streamlined and effective use of the spray repellant and flashlight, albeit in the form of a modified flashlight that is held upright (vertically) in contrast to traditional flashlights that are linear and held horizontally. FIG. 4 illustrates a side view of an alternate embodiment of the spray-integrated flashlight 401 having a curved segment by which the light-emitting area 430 and the handle body 410 are connected. FIG. 4 shows the spray-integrated flashlight 401 comprising a handle body 410 connected to a curved segment 445, which terminates in a flashlight head 430. The handle body 410 further comprises a ribbed grip portion 420, light control button 425, spray trigger opening 436, spray nozzle opening 435, and battery lid 411. The repellent spray device 450 is once again housed within the cavity of the handle body 410 and obscured from view in this profile view. It is accessible through said spray trigger opening 436 and visible through spray nozzle opening 435. Unique to this embodiment, the curved segment 445 further comprises a rotational engagement portion 446, which indicates the point at which the flashlight head 430 and curved segment 445 are removed (as a single unit) from the handle body 410 via unscrewing. This disengagement method is utilized for the purpose of installing/replacing standard off-the-shelf repellent spray devices 450. Motion arrow 406 denotes the direction of light emission from the flashlight head 430. Light emission is controlled by the aforementioned light control button 425 by depressing it in a direction opposite but parallel to motion arrow 406. As in the previous embodiment, this button could be a sliding switch as well.

Figure 5:
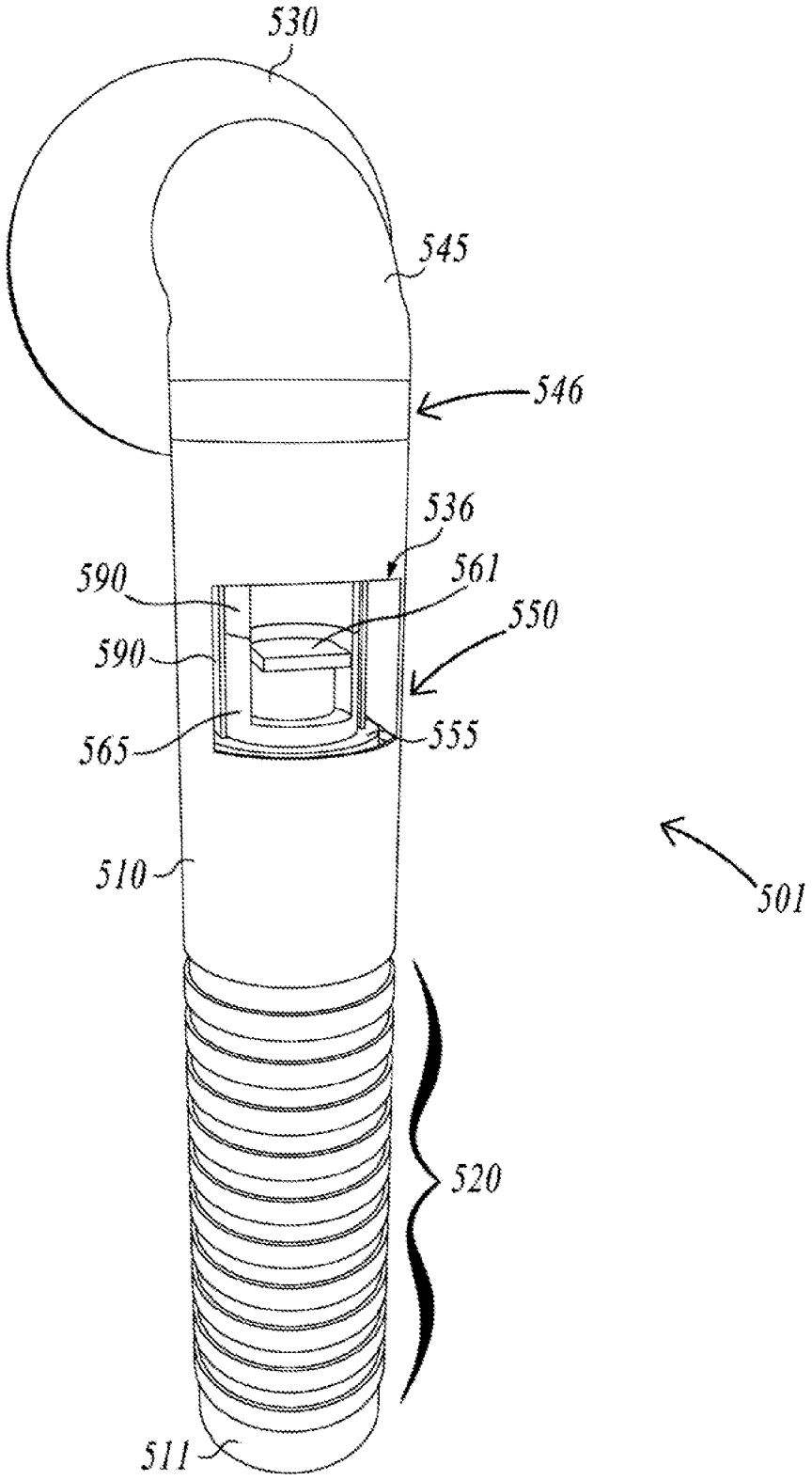
FIG. 5 illustrates a perspective rear view of an alternate embodiment of the spray-integrated flashlight with light-emitting area and spray nozzle facing away from the viewer.

FIG. 5 illustrates a perspective rear view of the alternate embodiment of the spray-integrated flashlight with light-emitting area and spray nozzle facing away from the viewer. The spray-integrated flashlight 501 comprises a handle body 510, curved segment 545 with rotational engagement portion 546, and flashlight head 530. The handle body further comprises ribbed grip portion 520, battery lid 511, and spray trigger opening 536, through which the repellent spray device 550 with chemical compound canister 555 and spray trigger 561 is visible/accessible. Additionally, spray device stabilization element 590 can be partially seen through spray trigger openings 536, within the hollow handle body 510. This spray stabilization element is permanently attached to, and extends from the bottom of, curved segment 545, and is configured to receive the top surface of the spray head 565 and spray canister 555 in order to prevent movement of the spray device 550. The precise structure of the stabilization element may vary in accordance with the specific type of employed spray device 550, but its purpose remains the same—to receive and stabilize the installed spray device and prevent unwanted movement during use. As well, the stabilization element 590 offer a unique solution for component stabilization within a system that designates its top portion for repellent spray device loading, and its bottom portion for large battery loading. The larger power source results in the ability to offer an industrial strength flashlight in conjunction with the benefits offered by a repellent spray device 550. The exploded view of FIG. 7 better illustrates the structure and function of stabilization element 590.

Figure 6:
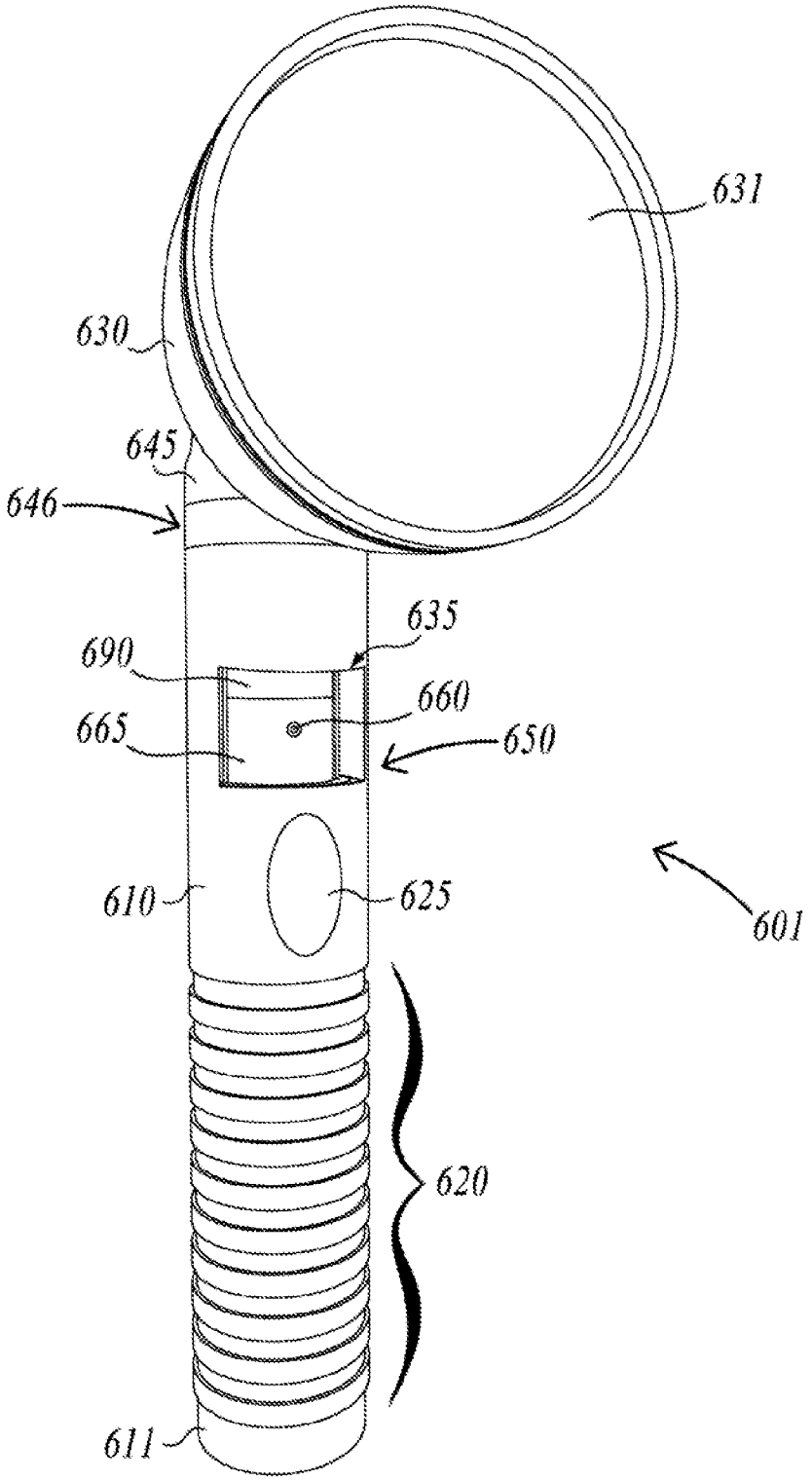
FIG. 6 illustrates a perspective frontal view of the alternated embodiment of the spray-integrated flashlight with light-emitting area and spray nozzle facing the viewer.

FIG. 6 illustrates a perspective frontal view of the alternate embodiment of the spray-integrated flashlight with light-emitting area and spray nozzle facing the viewer. The spray-integrated flashlight 601 possesses a handle body 610 with light control button 625, ribbed grip portion 620, and spray nozzle opening 635 through which the repellent spray device 650 expels its chemical compound. The spray device's spray head 665 possesses a spray nozzle 660 from which the spray is evacuated. Here again, spray device stabilization element 690 is in partial view, and can be seen here making contact with the top of the spray head 665. The handle body 610 terminates in the battery lid 611 on its bottom end. The flashlight head 630 further comprises a lens 631, and connects to the handle body 610 via the rotational engagement portion 646 of the curved segment 645. In this figure, the orientation of the spray-integrated flashlight makes it evident that the direction of both light emission and repellent compound evacuation travels away from a prospective user—whose line of sight travels in the same direction as well. This allows for the simultaneous illumination and spraying of a target, which is critical in time-sensitive, low-light situations where loss of focused light for even a second can have serious consequences.

Figure 7:
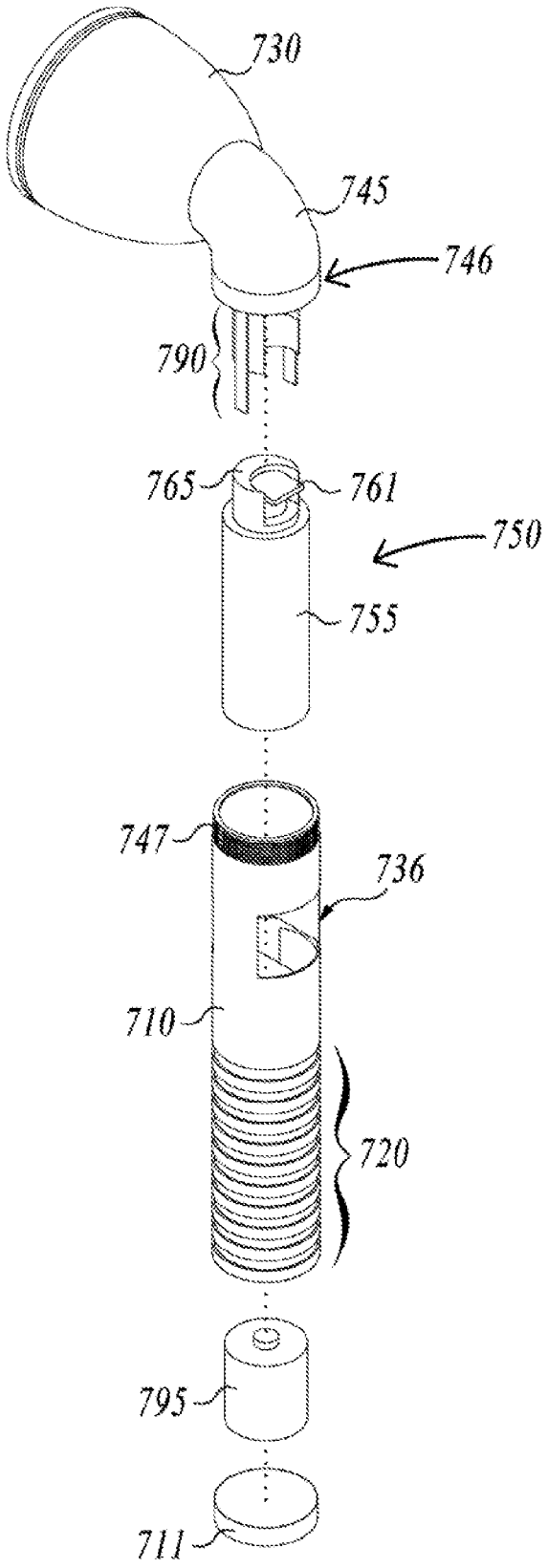
FIG. 7 illustrates an isometric exploded view of the alternate embodiment of the spray-integrated flashlight.

FIG. 7 illustrates an isometric exploded view of the alternate embodiment of the spray-integrated flashlight. The exploded view displays integral points of separation which allow for the replacement of the repellent spray device and battery. From top to bottom, the spray-integrated flashlight comprises a flashlight head 730 with curved segment 745, repellent spray device 750, handle body 710, battery 795, and battery lid 711. Further parsing these main elements, the curved segment 745 terminates in the rotational engagement portion 746 on its exterior, while its interior extends into the spray device stabilization element 790 (these elements were only partially visible in previous figures). The repellent spray device 750 further comprises the spray canister 755 and spray head 765 with trigger 761. The hollow handle body 710 further comprises spray nozzle opening 736, ribbed grip portion 720, and, unique to this figure, a rotational engagement tread 747 (which, making contact with the interior tread of the rotational engagement portion 746, was not visible in previous figures).

In regards to spray device 750 installation/replacement, the rotational engagement portion 746 can be screwed off of the rotational engagement tread 747, allowing replacement of the spray device 750. The engagement portion 746 can then be screwed back onto the tread 747. This rotational action causes the spray device stabilization element 790 to gradually come into contact with the top surfaces of the spray canister 755 and spray head 765 of the repellent spray device 750, holding it in a fixed position for regular usage of the spray-integrated flashlight. The stabilization element 790 may be configured thusly, or by using a more consolidated single-piece construction, ring-type structure, etc. In any case, the goal of the stabilization element is to stabilize the installed spray device 750 while accommodating its structure/dimensions. This figure also shows the battery lid 711 separated from the bottom of the handle body 710 to reveal the battery 795 housed in the interior of the handle body 710 (within grip portion 720). The battery 795 powers the flashlight head 730 from its position via connective wiring running inside of the handle body 710. The battery lid 711 may possess a threaded portion for screwing it on and off of the handle body 710 or utilized other conventional attachment means (e.g. latch/hinge, snap-on etc.). A plurality of batteries may be utilized depending on space availability within the handle body 710 and power requirements, with height being a key factor. Regardless of the number of batteries installed, the invention advantageously provides the capacity to hold a larger sized power source which can provide energy to the full-powered flashlight head 730, while still allowing room for a full-sized repellent spray device 750.

While there have been described herein what are considered to be preferred and exemplary embodiments of the present invention, other modifications of the invention shall be apparent to those skilled in the art from the teachings herein. For example, the relative dimensions of the device may be altered while keeping within the spirit and teachings of the invention. Further, although the objective of this invention is to provide a full-powered or full-sized flashlight that also has spray repellant functionality, the embodiments of the invention could be adapted for smaller flashlights or LED light devices. It is therefore desired to be secured, in the appended claims all such modifications as fall within the spirit and scope of the invention.

What is claimed is:

1. A flashlight with integrated spray repellent comprising:

an elongated linear main body having a proximal end that terminates with a battery lid configured to receive one or more batteries and a distal end that terminates with a flashlight head;

wherein the main body further comprises a light control button that activates and deactivates the flashlight;

a spray repellent device housed within the main body, said spray repellent device further comprising a spray head and a spray canister containing a repellent substance;

a flashlight head assembly comprising a flashlight head that emits a beam of light, a curved segment, a rotational engagement element, and a spray device stabilization element;

wherein the rotational engagement element reversibly engages the flashlight head assembly with the main body;

wherein the spray device stabilization element is configured to receive a top surface of the spray head and the spray canister;

wherein the spray head further comprises a spray trigger and a spray nozzle, the spray trigger configured to activate the release of the repellent substance from the spray canister via the spray nozzle;

wherein the main body has two opposing openings: a spray trigger opening for accessing the spray trigger and a spray nozzle opening for expelling the spray repellent;

wherein the spray trigger and the light control button are positioned adjacent to one another on opposite sides of the main body;

wherein the flashlight head is perpendicular to the main body; and wherein the spray nozzle and flashlight head are adjacent to one another and aligned to face the same direction such that the repellent substance is released from the spray nozzle in the same direction as the beam of light emitted from the flashlight head, thereby allowing the repellent to be released towards an area that is illuminated by the beam of light.

2. The flashlight with integrated spray repellent of claim 1 wherein the spray trigger and the light control button are positioned such that they can be simultaneously manipulated by a user's hand.

* * * * *